United States Patent [19]

McGowen et al.

[11] Patent Number: 5,036,690

[45] Date of Patent: Aug. 6, 1991

[54] FLEXIBLE PIPE END CRIMPING APPARATUS

[75] Inventors: Gregory S. McGowen, Williamsport; Arthur H. Clawson, Jr., Attica, both of Ind.

[73] Assignee: Tru-Flex Metal Hose Corporation, West Lebanon, Ind.

[21] Appl. No.: 594,315

[22] Filed: Oct. 9, 1990

[51] Int. Cl.[5] ..... B21C 37/12

[52] U.S. Cl. ..... 72/49; 72/137

[58] Field of Search ..... 72/49, 50, 135, 137

[56] References Cited

U.S. PATENT DOCUMENTS

| | | | |
|---|---|---|---|
| 1,383,187 | 6/1921 | Brinkman et al. | 72/49 |
| 1,596,215 | 8/1926 | Palmer | 72/49 |
| 3,073,944 | 1/1963 | Yuter | 72/49 |
| 4,197,728 | 4/1980 | McGowen | 72/49 |

*Primary Examiner*—Lowell A. Larson

*Assistant Examiner*—Don Gurley

*Attorney, Agent, or Firm*—Litman, McMahon & Brown

[57] ABSTRACT

An apparatus for crimping the ends of flexible pipe sections is adapted for mounting on a machine for winding flexible pipe from steel bands. The pipe forming machine includes multiple pairs of roller dies for profiling a flat metal band to a configuration with flanges on leading and trailing edges of the band. The profiled band is wound on a mandrel and the adjacent flanges of respective bindings interlock as the profiled band is spiral-wound on the mandrel. The crimping apparatus is mounted upstream of the mandrel and receives the profiled band. The crimping apparatus includes a pair of roller arm assemblies each mounting a roller die. The roller arm assemblies are interconnected by a toggle linkage mechanism which is connected to a linear actuator for moving the roller arm assemblies between engaged positions for compressing the flanges to non-interlocking configurations and disengaged positions.

20 Claims, 3 Drawing Sheets

FLEXIBLE PIPE END CRIMPING APPARATUS

BACKGROUND OF THE INVENTION

1. Field of the Invention

The present invention relates generally to forming flexible metal pipe, and in particular to an apparatus for crimping the pipe ends.

2. Description of the Related Art

Flexible metal piping can be formed by spiral-winding a metal band on a rotating mandrel, with the band having a profile including flanges for interlocking adjacent pipe windings. For example, the McGowen U.S. pat. No. 4,197,728 discloses a flexible piping method and apparatus of producing same. Such flexible piping can be used in many applications, including the exhaust systems of some vehicles which require some flexibility. A pipe winding machine, such as that shown in the McGowen '728 patent can produce pipe sections of practically unlimited length and can produce pipe sections with various diameters.

Finishing the ends of the flexible pipe can require substantial effort and expense if the ends are deburred. When flexible pipes are cut, e.g. with plasma cutters, cutoff saws, etc., sharp burrs may be present on the pipe section ends. Such jagged, burred ends can be dangerous to people who handle the flexible pipe sections, particularly if they neglect to wear protective gloves. Lacerations and similar injuries can be inflicted by such pipe ends, which can also damage property that they are exposed to.

To avoid some of these risks, flexible pipe sections can be deburred with grinding wheels, files, etc., but such deburring operations tend to be labor intensive and expensive in relation to the cost of the flexible piping.

The McGowen '728 patent discloses a shaping tool for altering the profile of the band to a noninterlocking configuration whereby a free winding is formed with crimped pipe section ends on either side. The present invention performs a similar function with an improved crimping apparatus, and addresses some of the aforementioned problems.

SUMMARY OF THE INVENTION

In the practice of the present invention, a flexible pipe end crimping apparatus is provided for a machine for spiral-winding flexible pipe from a band of material with leading and trailing edges. A pipe winding machine can include multiple pairs of rollers for profiling the material band to a pre-winding configuration with flanges adapted for interlocking on the mandrel. The crimping apparatus includes upper and lower roller arm assemblies each mounting a respective roller die, with the band extending therethrough. Each roller arm assembly includes a roller die for engaging the band when the roller arm assemblies are in engaged positions. The roller dies crimp the band flanges to noninterlocking configurations whereby a free winding is formed with adjacent, crimped edges on the ends of pipe sections on either side thereof. A toggle linkage mechanism interconnects the roller arm assemblies and shifts them between engaged and disengaged positions. A linear actuator, such as a pneumatic piston-and-cylinder unit, actuates the toggle linkage mechanism. A profiled material band is drawn through the crimping apparatus. An engage signal is generated by a control system and actuates the linear actuator to shift the roller assemblies to their engaged position by toggling the toggle linkage mechanism. A predetermined time interval can be provided for the engaged configuration of the apparatus, thus forming a winding corresponding to a complete revolution of the mandrel or a predetermined fraction thereof.

The principal objects and advantages of the present invention include providing an apparatus for crimping flexible pipe ends; providing such an apparatus which facilitates separation of adjacent flexible piping sections; providing such an apparatus which can reduce risks associated with handling flexible pipe sections as compared to flexible pipe sections with burred ends; providing such an apparatus which is economical to manufacture, efficient in operation, capable of a long operating life and particularly well adapted for the proposed uses thereof; and providing such an apparatus which is adapted for use with existing flexible pipe winding machines.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 13:
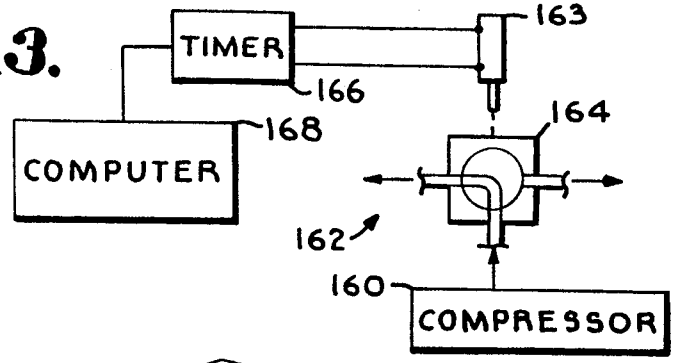
FIG. 13 is a schematic view of the crimping apparatus, showing a control system thereof.
Figure 1:
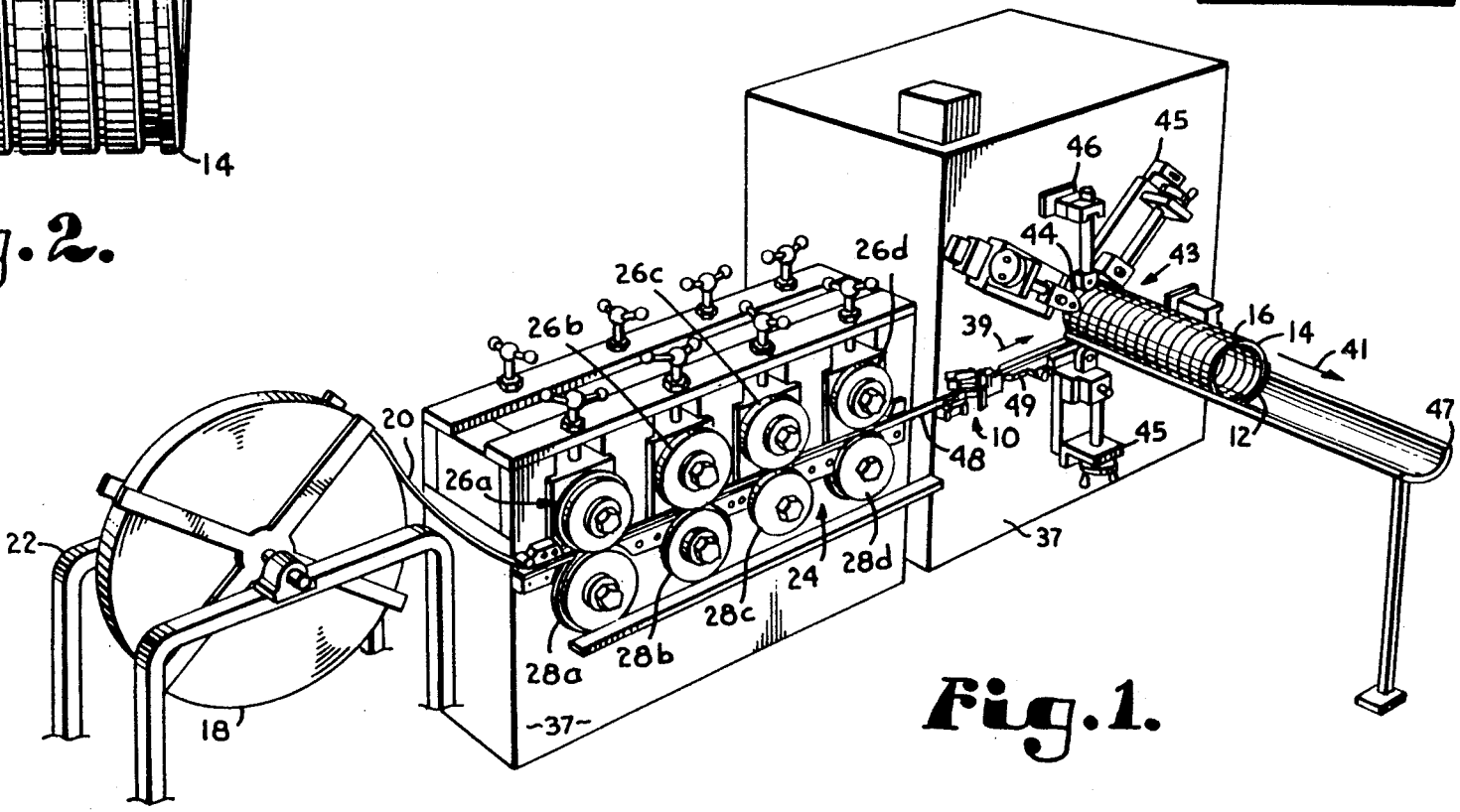
FIG. 1 is a perspective view of a machine for winding flexible pipe with an end crimping apparatus embodying the present invention.
Figure 2:
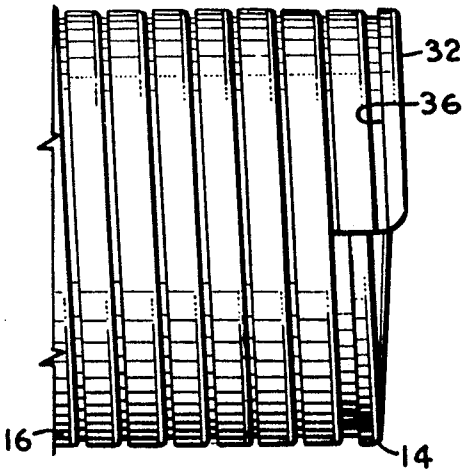
FIG. 2 is an enlarged, fragmentary, side elevational view of a flexible pipe with a crimped end.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

Referring to the drawings in more detail, the reference numeral 10 generally designates an apparatus for crimping ends 12 of sections 14 of spiral-wound flexible pipe 16.

Without limitation on the generality of useful applications of the crimping apparatus 10, it is shown mounted on a machine 17 for winding flexible piping 16. Such an apparatus is shown in the McGowen U.S. pat. No. 4,197,728, which is incorporated herein by reference. The machine 17 includes a coiled supply 18 of a flat metal band 20 rotatably mounted on a band supply frame 22. A band-forming station 24 is located downstream of the coiled supply 18 and includes four upper roller dies 26*a, b, c, d* respectively paired with four lower roller dies 28*a, b, c, d*. The roller dies 26*a–d* and 28*a–d* have respective edge geometries for forming or profiling the band in successive stages as follows: 1) roller dies 26*a* and 28*a* form a double bend 30 approximately centered between first (leading) and second (trailing) edges 32, 34 of the band 20; 2) roller dies 26*b*, 28*b* turn down the first edge 32 to form a first edge or side flange 36; 3) roller dies 26*c*, 28*c* turn up the second edge 34 to form a second edge or side flange 38; 4) the roller dies 26*d*, 28*d* pivot or fold the edge flanges 36, 38 inwardly whereby the profile of the band 20 as it leaves the forming station 24 includes first and second channels 40, 42 adjacent the first and second side edges 32, 34 respectively. The channels 40, 42 are open downwardly and upwardly respectively.

Figure 9:
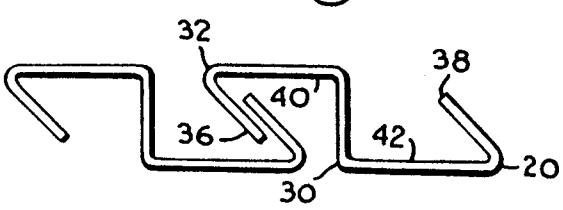
FIG. 9 is an enlarged, fragmentary, cross-sectional view of an adjacent pair of windings, shown engaged just prior to interlocking.
Figure 10:
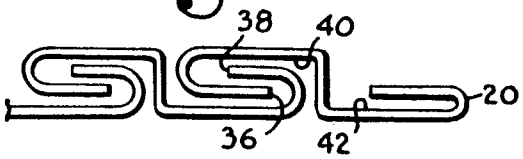
FIG. 10 is an enlarged, fragmentary, cross-sectional view of the formed flexible pipe, showing adjacent windings thereof interlocked.

A pipe forming or winding station 43 of the machine 17 includes a mandrel 44 which can be rotatably driven for winding the flexible pipe 16 from the profiled band 20. The pipe forming station 43 includes ironer roller assemblies 45, for example, three of which are provided at approximately 120 degree radial intervals with respect to each other for interlocking the bands 20 whereby the flexible pipe 16 is formed. In particular, the ironer roller assemblies 45 transform band windings 21 from engaged configurations with respective side flanges 36, 38 engaged and received in respective side channels 40, 42, as shown in FIG. 9, to interlocking configurations as shown in FIG. 10 with respective side flanges 36, 38 folded in interlocking relationship. With the band windings 21 secured together as shown in FIG. 10, axial slippage or sliding therebetween is permitted whereby the resulting pipe 16 is flexible.

Suitable guide rollers, such as that shown at 46, can be placed where necessary at the forming station 43 for guiding the band 20 and maintaining it in proper alignment. The finished pipe 16 can be directed away from the forming station 43 by a trough, such as that shown at 47, in the direction of an arrow 41 which is oriented approximately 90 degrees with respect to an arrow 39 indicating the direction of movement of the band 20 through the forming station 43. At the forming station 43, the machine 17 includes an inner face 37, which can mount the ironer roller assemblies 45 and the guide roller assembly 46.

An upstream bridging band guide 48 extends from the band forming station 24 to a crimping station 35 where the crimping apparatus 10 is located, and a downstream bridging band guide 49 extends from the crimping station 35 to the pipe forming station 43.

II. End Crimping Apparatus 10

The end crimping apparatus 10 includes a body 50 mounted on the inside face 37 of the pipe winding machine 17 between the band forming station 24 and the pipe forming station 43. The body 50 includes upstream and downstream ends 52, 54 with respective channels 56, 58 receiving the band guides 48, 49. A pair of tabs 60 extend upwardly on either side of the upstream body channel 56. A gap 62 is formed between the body ends 52, 54 immediately downstream from the tabs 60. A body lower edge 64 includes an upstream portion 66, an offset 68 below the gap 62, and a downstream portion 70, the lower edge downstream portion 70 being positioned below the level of the lower edge upstream portion 66.

Upper and lower roller arm assemblies 74, 76 each includes a pair of roller arms 78 with upstream/proximate and downstream/distal ends 80, 82 interconnected by a spacer 84 with opposite sides 86 each mounting a respective roller arm 78 and including spacer upstream and downstream ends 88, 90. The spacer downstream end 90 includes a notch 92 open in a downstream direction.

The upper roller arm assembly 74 includes an upper roller die 94 rotatably mounted between the arm downstream ends 82 by pivotal connectors 106*a* on a pivotal axis 108*a* and including inner and outer peripheral contact edges 96, 98. The lower roller arm assembly 76 includes a lower roller die 100 rotatably mounted by pivotal connectors 106*b* on a pivotal axis 108*b* and including inner and outer peripheral contact edges 102, 104. Pivotal connectors 106*c* pivotally connect the arm upstream ends 80 of the upper roller arm assembly 74 to the tabs 60 on a pivotal axis 108*c*. Pivotal connectors 106*d* pivotally connect the arm upstream ends 80 of the lower lower roller arm assembly 76 to the body 50 on a pivotal axis 108*d* in spaced relation below the tab 60 and the upstream channel 56.

A toggle linkage mechanism 112 includes a pair of upper toggle links 114 each having an upper end pivotally connected by a pivotal connector 106*e* on a pivotal axis 108*e* to a respective upper roller arm 78 in closely-spaced relation upstream from the pivotal axis 108*a*. Each upper toggle link 114 also includes a lower end 114*b*. A pair of lower toggle links 116 each includes an upper end 116*a* pivotally connected by a pivotal connector 106*f* on a pivotal axis 108*f* to a respective upper toggle link lower end 114*b*. Each lower toggle link 116 also includes a lower end 116*b*. The upper toggle link lower end 114*b* and the lower toggle link upper end 116*a* can be notched or recessed to provide reduced-thickness ends 114*b* and 116*a* which pivotally mate.

In closely-spaced relation below its upper end 116*a*, each lower toggle link 116 is pivotally connected by a pivotal connector 106*g* on a pivotal axis 108*g* to a respective lower roller arm 78 closely upstream from a respective lower roller die pivotal axis 108*b*.

A linear actuator system 118 includes a fluid-actuated piston-and-cylinder unit 120 with upstream and downstream ends 121, 123 mounted below the upstream portion 66 of the body lower edge 64 by a pair of mounting bars 122 attached, e.g. welded, on each side of the body 50 at approximately the level of the lower edge upstream portion 66. Each mounting bar 122 includes upstream and downstream receiver slots 124 which extend generally parallel to the path of movement of the band 20 whereby the piston-and-cylinder unit 120 can be adjustably positioned upstream and downstream with respect to the body 50. The piston-and-cylinder unit 120 includes a shaft 125 terminating at a male-threaded outer, downstream end 126 which threadably receives a shaft extension 128 with a female-threaded upstream end 130 threadably secured to the shaft downstream end 126, a male-threaded shaft extension downstream end 132 and a shoulder 131 therebetween.

A toggle linkage connecting plate 144 includes opposite sides edges 146, a top edge 148 with an upwardly-open notch 150 centered between the side edges 146, a vertically-aligned, slotted receiver 152 positioned between the side edges 146, and a bottom edge 154. The side edges 146 are tapped to receive pivotal connectors 106*h* which pivotally interconnect the lower toggle link lower ends 116*b* and the connecting plate 144 on a pivotal axis 108*h*. The connecting plate 144 can be secured to the shaft extension 128 by a nut 156 threadably received on the shaft extension downstream end 132.

The piston-and-cylinder unit 120 can be pneumatically actuated with air conduits 158 connecting its ends 121, 123 to a pressurized air source, e.g. a compressor 160.

A control system 162 is provided for controlling the operation of the crimping apparatus 10, and includes a three-way air valve 164 actuated by a solenoid 163. The air valve 164 includes an inlet 164*a* fluidically coupled to the compressor 160 and first and second outlets 164*b*, 164*c* fluidically coupled to the air conduits 158. Timing means 166 is operably connected to the air valve 164 for controlling the duration of its operation.

The piston-and-cylinder unit 120 has retract and extend strokes and positions, and can comprise a double-acting unit, or a single-acting unit with a spring return. The pneumatic piston-and-cylinder unit 120 can be utilized with the present invention, but other linear actuators could also be employed, such as hydraulic piston-and-cylinder units, solenoids, etc.

III. Operation

The operation of the crimping apparatus 10 can be controlled by the control system 162, which in turn can be controlled manually or by a computer 168 to produce sections 14 of the flexible piping 16 having predetermined lengths. The flexible piping sections 14 preferably have crimped ends 12 and are separated on the mandrel 44 and as they leave the pipe winding station 43 by free windings or winding segments 170. The free windings or winding segments 170 can comprise partial or complete windings of the band 20 with the flanges 36, 38 folded flat—i.e. crimped—and unlocked with respect to the adjacent pipe section crimped ends 12, which also have their respective flanges 36, 38 crimped flat.

The operation of the crimping apparatus 10 can be controlled by the control system 162, which can provide for either manual or computer control of the timer and other control functions. For example, a computer can be programmed to actuate the crimping apparatus at certain predetermined intervals corresponding to lengths of separable flexible pipe sections and for certain, predetermined durations corresponding to the number of free windings or partial free windings separating the free sections. Although multiple and partial free windings can be provided, single, 360 degree turn free windings may normally be preferred so that the end cuts for the adjacent, crimped ends of two sections of flexible pipe could be made at approximately adjacent locations, i.e. without having to rotate the pipe sections.

Figure 6:
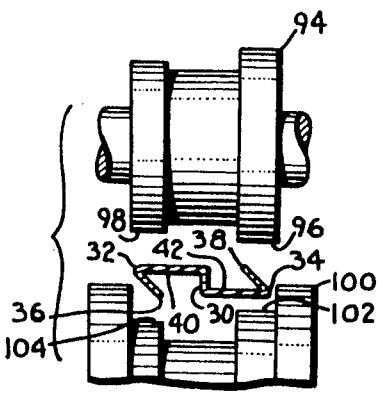
FIG. 6 is an enlarged, fragmentary, front elevational view of the crimping apparatus, particularly showing roller dies thereof in their disengaged positions.
Figure 5:
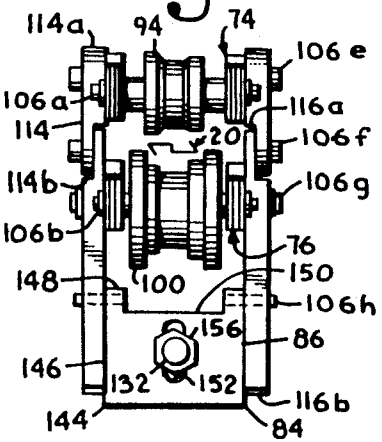
FIG. 5 is an enlarged, vertical, cross-sectional view of the crimping apparatus, taken generally along Line 5—5 in FIG. 4.
Figure 3:
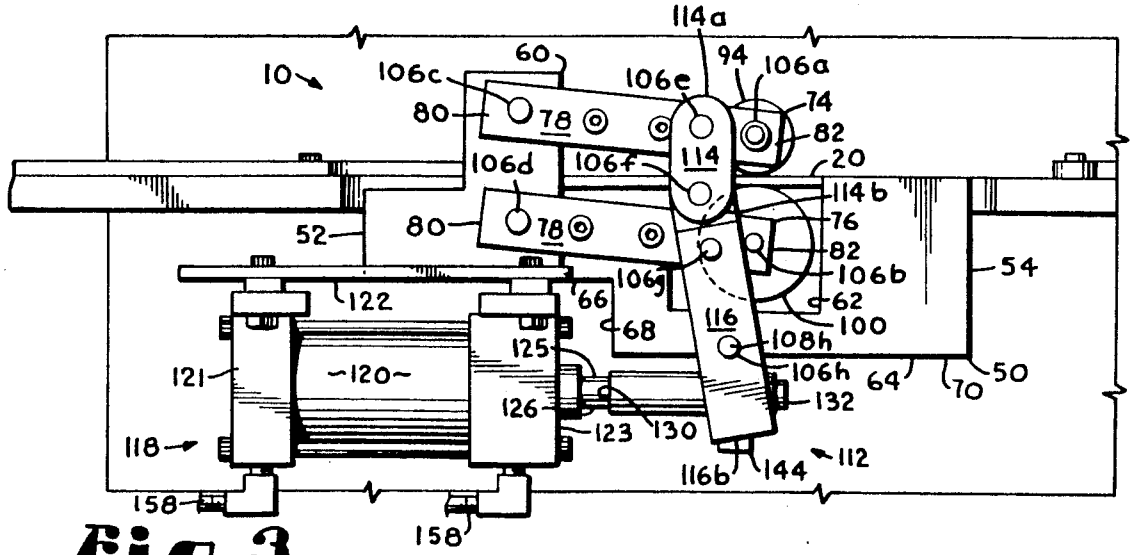
FIG. 3 is an enlarged, side elevational view of the crimping apparatus.
Figure 4:
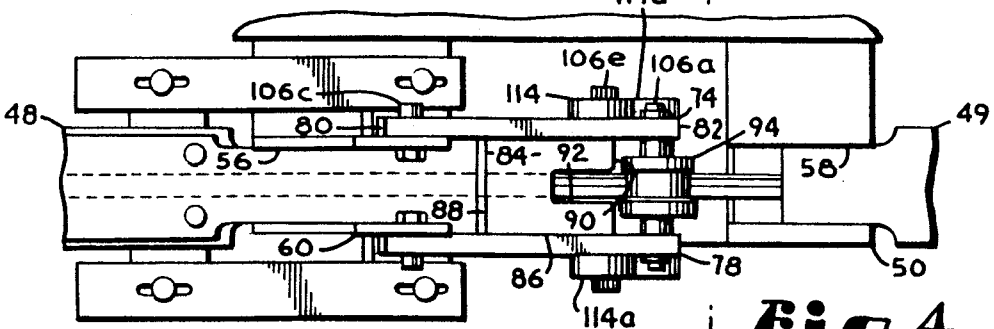
FIG. 4 is a top plan view of the crimping apparatus.
Figure 11:
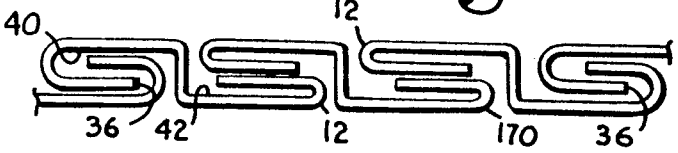
FIG. 11 is an enlarged, fragmentary, cross-sectional view of the finished flexible pipe, showing a free winding and crimped pipe ends on either side thereof.
Figure 12:
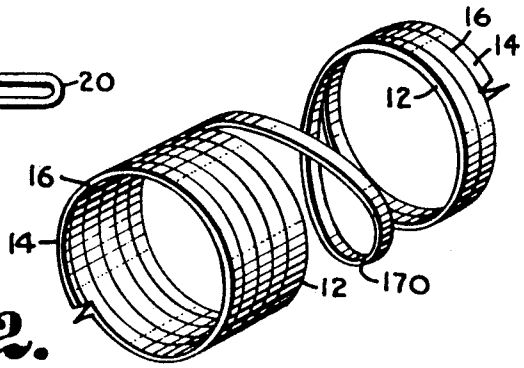
FIG. 12 is a fragmentary, perspective view of a pair of flexible pipe sections with crimped ends and a free winding therebetween.
Figure 7:
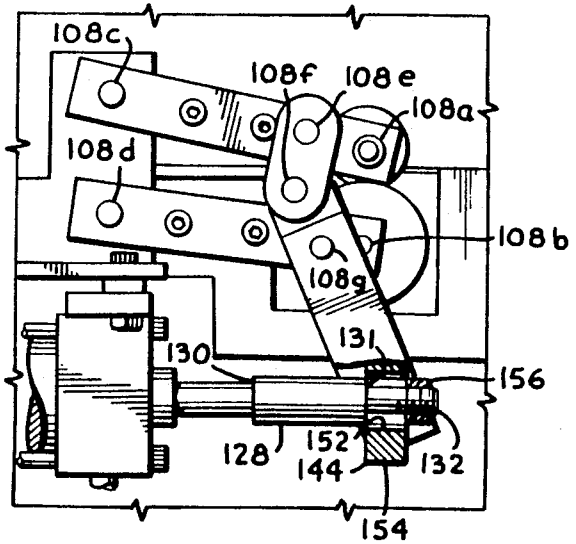
FIG. 7 is a fragmentary, side elevational view of the crimping apparatus, shown in its engaged position.
Figure 8:
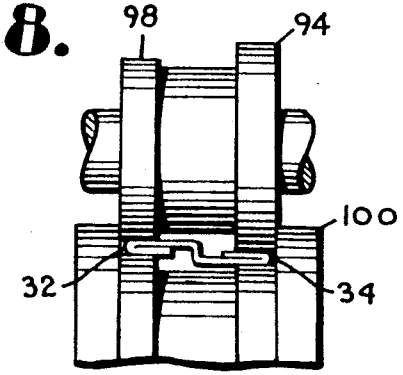
FIG. 8 is an enlarged, fragmentary, front elevational view of the crimping apparatus, particularly showing the roller dies in their engaged positions.

An "actuate" signal, e.g. from the computer 168 or from a manual input, of the control system 162 initiates the crimping process as follows: 1) the solenoid-actuated air valve 164 is configured to communicate pressurized air to the piston-and-cylinder unit upstream end for a predetermined duration by means of the timer 166; 2) the piston-and-cylinder unit effects an extend stroke; 3) the lower toggle link lower ends 116*b* swing downstream, with the toggle linkage connector plate pivoting therebetween about the pivotal axis 108*h*; 4) the lower toggle links 116 pivot (counter-clockwise as viewed in FIGS. 3 and 7) about the pivotal axis at 106*g*; 5) the lower toggle link upper ends 116*a* swing in an upstream direction, and pivot with respect to the upper toggle link lower ends 114*g* about the pivotal axis at 106*f*; 6) the upper toggle links 114 rotate (clockwise as viewed in FIGS. 3 and 7) about the pivotal axis 108*e*; 7) the upper roller arm assembly 74 swings downwardly, rotating in a clockwise direction (as viewed in FIGS. 3 and 7) about the pivotal axis 108*a*; 8) the clearance between the roller dies 94 and 100 narrows to a crimp configuration (FIG. 8); 9) the band flanges 36, 38 are rotated (counter-clockwise as viewed in FIGS. 6 and 9) to configurations which are essentially flattened against the band side portions 32, 34 (FIG. 8); and 10) a free, unattached winding 170 (FIGS. 11 and 12) is formed because the windings adjacent to the free winding 170 (FIG. 11) are unable to interlock therewith.

When a deactuation signal is generated by the control system 162, the solenoid-actuated air valve 164 is reconfigured for a retraction stroke, the piston-and-cylinder unit 120 effects a retraction stroke, and the crimp procedure described above is essentially reversed and the adjacent windings resume interlocking (FIG. 10).

It is to be understood that while certain forms of the present invention have been illustrated and described herein, it is not to be limited to the specific forms or arrangement of parts described and shown.

What is claimed and desired to be secured by Letters Patent is as follows:

1. A machine for winding flexible pipes from material bands, which comprises:
   (a) means
   (b) profiling means for longitudinally forming said material band into a cross-sectional profile with interlockable leading and trailing edges;
   (c) mandrel means for spiral winding said formed band;
   (d) interlocking means for interlocking said band on said mandrel into pipe with respective leading and trailing band edges interlocked; and
   (e) crimping means upstream of said mandrel means for crimping said band leading and trailing edges into non-interlocking relationship.

2. The invention of claim 1 wherein:
   (a) said crimping mean includes roller means for engaging said band leading and trailing edges.

3. The invention of claim 2 wherein said roller means includes:
   (a) first and second rollers having an engaged position engaged with said band and a disengaged position disengaged from said band.

4. The invention of claim 3 wherein said crimping means includes:
(a) roller actuating means for selectively moving said rollers between their engaged and disengaged positions.

5. The invention of claim 4 wherein:
(a) said actuating means comprises a fluid-actuated piston-and-cylinder unit and a linkage mechanism connected to said piston-and-cylinder unit.

6. The invention of claim 5 wherein said linkage mechanism includes:
(a) first and second roller arms mounting said first and second rollers respectively; and
(b) toggle means interconnecting said first and second roller arms.

7. The invention of claim 6, which includes:
(a) said crimping means having a body member;
(b) each said roller arm having a proximate end pivotally mounted on said crimping means and a distal end rotatably mounting a respective roller.

8. The invention of claim 4, which includes:
(a) timer means operably connected to said actuating means.

9. The invention of claim 8 wherein:
(a) said timer means is adapted for actuating said crimping means to its engaged position for a predetermined interval substantially corresponding to a complete revolution of said band around said mandrel.

10. The invention of claim 9, which includes:
(a) said timing means being adapted for causing said actuating means to place said crimping means in its disengaged position for a predetermined time interval.

11. In combination with a machine for forming flexible piping from a continuous band movable along said machine in a downstream direction and including leading and trailing edges, which machine includes profiling roller dies for forming a longitudinally extending double bend in said band and upturned and downturned flanges in said band edges, rotating mandrel means for spiral-winding said band, and ironing rollers for interlocking said band edge flanges the improvement of an end crimping apparatus which comprises:
(a) a body member fixedly mounted of said machine upstream of said mandrel
(b) first and second roller assemblies each including:
(1) a roller arm with a proximate end pivotally mounted on said body and a distal end; and
(2) a roller die rotatably mounted on said arm distal end;
(c) said roller forming a band clearance space therebetween; (d) said roller assemblies having engaged positions. with said clearance space narrowed and disengaged positions with said clearance space widened;
(e) actuator means for selectively actuating said roller assemblies between their engaged and disengaged positions.

12. The invention of claim 11 wherein said actuator means includes:
(a) a toggle linkage mechanism interconnecting said roller arms; and
(b) linear actuator means connected to said linkage mechanism and having a retracted position with said roller assemblies in their disengaged positions and an extended position with said roller assemblies in their engaged positions.

13. The invention of claim 12 wherein:
(a) said linear actuator means comprises a double-acting pneumatic piston-and-cylinder unit with upstream and downstream ends; and
(b) said piston-and-cylinder unit including upstream and downstream air inlets.

14. The invention of claim 13, which includes:
(a) a three-way air valve with a pressurized air inlet and first and second outlets communicating with said piston-and-cylinder unit upstream and downstream air inlets respectively.

15. The invention of claim 14, which includes:
(a) said air valve having a first position communicating said inlet and said first outlet and a second position communicating said inlet and said second outlet.

16. The invention of claim 15, which includes:
(a) a solenoid connected to said air valve for shifting said air valve between its first and second positions.

17. The invention of claim 16, which includes:
(a) a timer operably connected to said solenoid for maintaining said air valve in its first position for a predetermined duration.

18. The invention of claim 12 wherein said toggle linkage mechanism includes:
(a) a first link pivotally connected to said first roller arm; and
(b) a second pivotally connected to said first link, said second roller arm and said linear actuator means.

19. The invention of claim 18, which includes:
(a) a connecting plate pivotally connected to said second link and to said linear actuator means.

20. In combination with a machine for forming flexible piping from a continuous band movable along said machine in a downstream direction and including leading and trailing edges, which machine includes profiling roller dies for forming a longitudinally extending double bend in said band and upturned and downturned flanges in said band edges, rotating mandrel means for spiral-winding said band, and ironing rollers for interlocking said band edge flanges, the improvement of an end crimping apparatus which comprises:
(a) a body including:
(1) an upstream end;
(2) a downstream end;
(3) a top edge with a channel receiving a flowpath of said band;
(4) a bottom edge;
(5) a pair of tabs extending upwardly in proximity to said body upstream end over said channel; and
(6) said top edge including an upwardly open notch downstream from said tabs;
(b) upper and lower roller arm assemblies each
(1) a pair of arms with upstream and downstream ends; and
(2) a spacer with upstream and downstream ends and opposite side edges, each said side edge mounting a respective arm intermediate its ends, said spacer downstream end having a notch open in a downstream direction;
(c) said upper and lower roller assemblies including upper and lower roller dies respectively, each roller die including inner and outer annular contact edges selectively engageable with said trailing and leading edge flanges respectively;
(d) a toggle linkage mechanism including:
(1) a pair of upper toggle links each having upper and lower ends;

(2) a pair of lower toggle links each having top and bottom ends; and (3) a toggle liinkage connecting plate including top and bottom edges and opposite side edges, said top edge including an upwardly-open notch;

(e) a first pair of pivotal connectors each pivotally interconnecting said upper roller die and a respective upper roller assembly arm downstream ends on a first pivotal axis;

(f) a second pair of pivotal connectors each pivotally interconnecting said lower roller die and a respective lower roller arm downstream ends on a second pivotal axis;

(g) a third pair of pivotal connectors each pivotally interconnecting a respective upper link arm upstream end and a respective tab on a third pivotal axis;

(h) a fourth pair of pivotal connectors each pivotally interconnecting a respective lower link arm upstream end and said body on a fourth pivotal axis;

(i) a fifth set of pivotal connectors each pivotally interconnecting a respective upper link upper end and a respective upper roller arm on a fifth pivotal axis;

(j) a sixth set of pivotal connectors each pivotally interconnecting a respective upper link lower end and a respective lower link upper end on a sixth pivotal axis;

(k) a seventh set of pivotal connectors each pivotally interconnecting a respective lower link and a respective lower roller arm on a seventh pivotal axis;

(l) an eighth pair of pivotal connectors each pivotally interconnecting a respective lower link lower end and a respective linkage connecting plate side edge on an eighth pivotal axis;

(m) said first pivotal axis being located above said second pivotal axis, said third pivotal axis being located above said fourth pivotal axis, said fifth pivotal axis being located between said first and third pivotal axes, said seventh pivotal axis being located between said second and fourth pivotal axes, said sixth pivotal axis being located between said fifth and seventh pivotal axes, said eighth pivotal axis being located below said seventh pivotal axis, and said seventh pivotal axis being located below said fifth pivotal axis;

(n) a pneumatic piston-and-cylinder unit including a cylinder with upstream and downstream ends and a shaft having an upstream end within said cylinder and a downstream end extending downstream from said cylinder, said shaft being pneumatically movable between extended and retracted positions;

(o) a pair of piston-and-cylinder unit mounting bars each mounted on a respective side of said body at the lower edge thereof adjacent to said body upstream end, each said mounting bar including upstream and downstream longitudinally aligned receiver slots;

(p) four mechanical fasteners each longitudinally slidably received in a respective mounting bar slot and fastened to said piston-and-cylinder unit;

(q) a shaft extension with an upstream end threadably mounted on said shaft downstream end and a downstream end attached to said mounting plate;

(r) a control system including:

(1) means for generating actuate and deactuate electrical signals;

2) a three-way air valve with a compressed air input, a first output and a second output;

(3) said valve having a first position communicating said inlet and said first outlet and a second position communicating said inlet and said second outlet;

(4) a solenoid electrically coupled to said signal generating means for shifting said valve between its first and second positions in response to actuate and deactuate signals from said signal generating means; and (5) means for timing a duration of said actuate signal; and (s) first and second air conduits pneumatically communicating said air valve first and second outlets with said piston-and-cylinder unit upstream and downstream ends respectively.

* * * * *